US007092650B2

(12) United States Patent
Nagato

(10) Patent No.: US 7,092,650 B2
(45) Date of Patent: Aug. 15, 2006

(54) COLOR IMAGE FORMING APPARATUS

(75) Inventor: Hitoshi Nagato, Kunitachi (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 121 days.

(21) Appl. No.: 10/951,625

(22) Filed: Sep. 29, 2004

(65) Prior Publication Data

US 2005/0220471 A1 Oct. 6, 2005

(30) Foreign Application Priority Data

Mar. 30, 2004 (JP) ..... 2004-099374

(51) Int. Cl.
*G03G 15/02* (2006.01)

(52) U.S. Cl. ..... 399/50; 399/48; 399/51

(58) Field of Classification Search ..... 399/48, 399/49, 50, 51
See application file for complete search history.

(56) References Cited

U.S. PATENT DOCUMENTS 5,243,383 A * 9/1993 Parisi ..... 399/50
6,647,219 B1 * 11/2003 Buettner ..... 399/48

FOREIGN PATENT DOCUMENTS

JP 2769704 4/1998

* cited by examiner

*Primary Examiner*—Hoang Ngo
(74) *Attorney, Agent, or Firm*—Oblon, Spivak, McClelland, Maier & Neustadt, P.C.

(57) ABSTRACT

There is disclosed in an IOI system which predicts surface potentials of a photosensitive drum positioned in developing positions of individual developing devices from detection results of the surface potentials by two surface potential sensors per developing device, disposed before/after the developing device of each of the plurality of image forming units before/after expose and which controls a charging device in such a manner that a predicted value of the surface potential before the expose indicates a defined developing reference value and which controls an exposing device in such a manner that the predicted value of the surface potential after the expose indicates a defined expose reference value. The image forming units of second and subsequent colors, a charging amount by the charging device is controlled in consideration of charging histories by the charging devices of previous colors.

19 Claims, 6 Drawing Sheets

COLOR IMAGE FORMING APPARATUS

CROSS-REFERENCE TO RELATED APPLICATIONS

This application is based upon and claims the benefit of priority from prior Japanese Patent Application No. 2004-099374, filed Mar. 30, 2004, the entire contents of which are incorporated herein by reference.

BACKGROUND OF THE INVENTION

1. Field of the Invention

The present invention relates to a color image forming apparatus in which a plurality of image forming units are arranged around a photosensitive member and in which a plurality of colors of toner images are superimposed on the photosensitive member to obtain a color image.

2. Description of the Related Art

In color image forming apparatuses, various systems have been adopted in order to achieve miniaturization, speeding-up of processes, and enhancement of position accuracy in superimposing images of color components. For example, there is an image forming apparatus of electronic photography, in which toner images developed by toners formed of four coloring materials of yellow (Y), magenta (M), cyan (C), and black (BK) are superimposed on one photosensitive member to obtain a full-color image.

As one example of a full-color image forming apparatus, there is a process (Image On Image process, hereinafter referred to as IOI process) in which charging, exposing, and developing are successively repeated on one photosensitive member for each color of toner, and monochromatic toner images are superimposed on the photosensitive member, and thereafter collectively transferred onto a transfer member. A color image forming apparatus which performs the IOI process is utilized in a color printer, or a color copying machine, and in on-demand printing or color proof in a printing field.

For example, in Jpn. Pat. No. 3208670 (pages 8, 9, FIGS. 1 and 9), an apparatus has been described in which a charging potential of the photosensitive member, or an image density is detected to control a charging device, an exposing device, or a developing device. When the surface potential on a photosensitive drum is detected by a single charging electrometer, the charging device or the exposing device is controlled in such a manner that the surface potentials of unexposed and exposed portions indicate present reference values. When the density of the toner image on the photosensitive drum is detected, a developing bias is controlled in such a manner as to set the toner image density to the reference value.

For example, in Jpn. Pat. No. 2769704 (pages 3, 4, FIGS. 1 and 2), an apparatus is described in which a plurality of surface potential sensors are used in order to calculate the surface potential in a developing device position of the photosensitive member. Potentials in a plurality of developing unit positions are calculated from potential differences on the photosensitive member, detected by first and second surface potential sensors, a charging amount of the charging unit is controlled in such a manner as to adjust the surface potentials in a plurality of developing unit positions into set values, and a color image is obtained.

However, it is difficult to apply the technique described in the Jpn. Pat. Nos. 3208670 or 2769704 to the IOI process, because it is necessary to control image formation in consideration of fluctuations or differences of characteristics in a plurality of elements such as charging and exposing devices.

Especially in the IOI process, a charging step of the next stage has to be performed before influences of the charging by the charging device of the previous stages are reduced. Additionally, the next image forming process is performed in such a manner as to superimpose an image upon a toner image formed in the previous stage. Therefore, if the influences on charging characteristics by the image forming process in the previous stage are not considered, correct image forming control cannot be performed, and there is a problem that an image quality drops.

In the color image forming apparatus which performs the IOI process, a potential on the surface of the photosensitive member changes even in the use on the same conditions by changes of environments such as ambient temperature, humidity, and temperature in the apparatus, a drop of capability of a charging device and a change of a characteristic such as a resistance value of the surface of the photosensitive member after the use for a long time. Further, because of changes of characteristics of a developer with time, it is difficult to maintain image qualities in broad senses, such as density and color of a toner image, constantly in certain states.

BRIEF SUMMARY OF THE INVENTION

An object of the present invention is to enhance an image quality of a color image in an IOI process in which a plurality of toner images are superimposed upon one another on a photosensitive member.

According to an aspect of the invention, there is provided a color image forming apparatus comprising: a photosensitive member having a photosensitive layer and capable of holding a plurality of developed color images; a plurality of image forming units arranged around the photosensitive member, each having a charging device, an expose device, and a developing device, each image forming unit forming one of the plurality of developed color images; a plurality of sensors to detect surface potentials of the photosensitive member, in each position between the charging device and the developing device of each of image forming unit and in a position of downstream side of a last developing device which form the last one of developed color images on the photosensitive member; an estimate device configured to estimate a predicted value of the surface potential of the photosensitive layer for one of developing devices using a first potential representing a surface potential before developing process of one of the developing devices and a second potential representing a surface potential after developing process of the other one of developing devices; and a control device configured to control the corresponding one of charging devices in the corresponding image forming unit in such a manner that the predicted value reaches to a predetermined developing reference value for the one of developing devices.

Additional objects and advantages of the invention will be set forth in the description which follows, and in-part-will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment of the present invention will be described with reference to the drawings.

Figure 1:
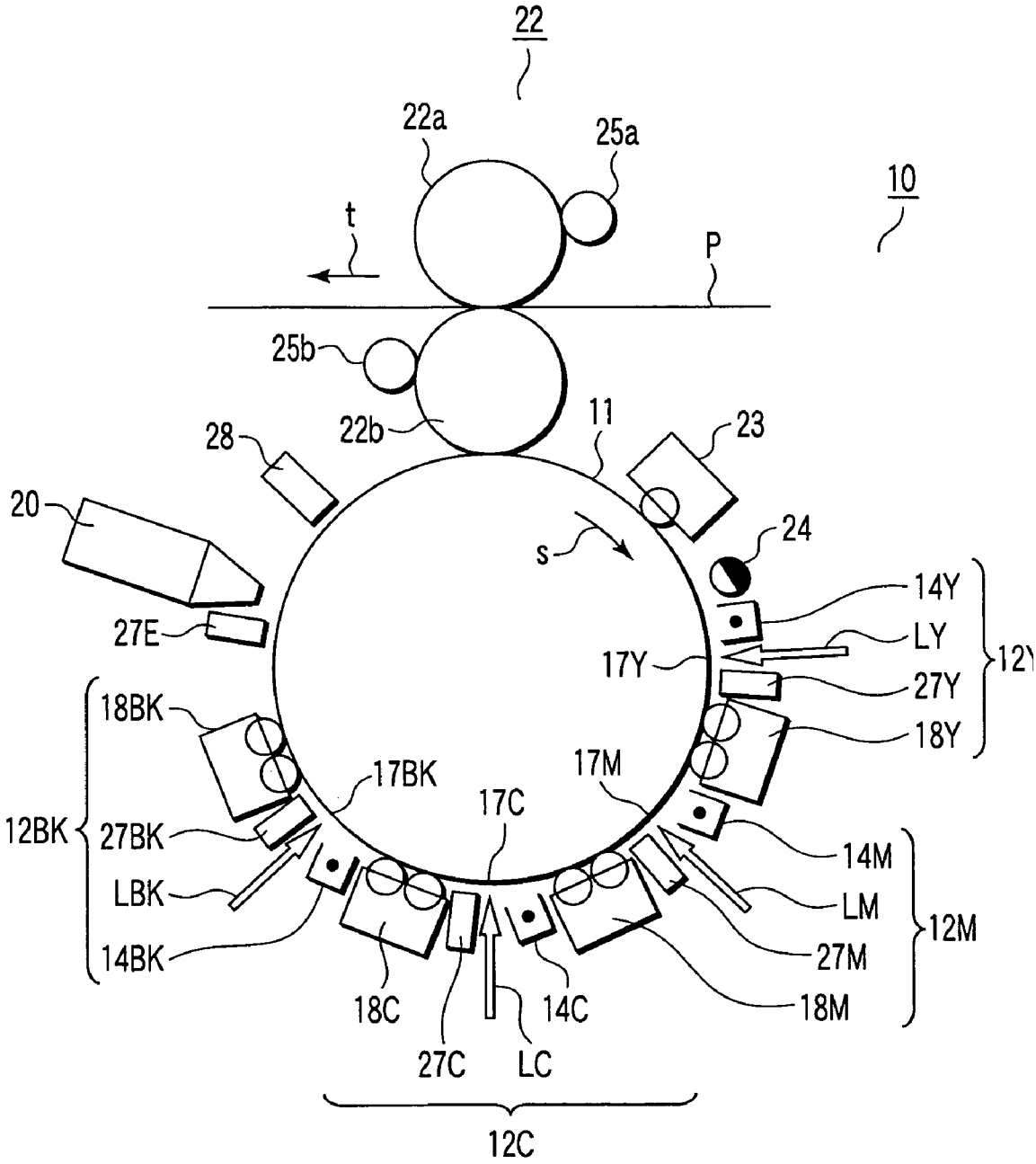
FIG. 1 is a schematic diagram showing one embodiment of an image forming section of a color electrophotographic apparatus.

FIG. 1 shows an image forming section 10 of a wet type full-color electrophotographic apparatus which is a color image forming apparatus. The image forming section 10 has a photosensitive member, that is, a photosensitive drum 11 in which an organic photosensitive layer or amorphous silicon-based photosensitive layer is formed, for example, on a conductive substrate of aluminum or the like. First to fourth image forming units 12Y, 12M, 12C, 12BK which form toner images of yellow (Y), magenta (M), cyan (C), and black (BK) are arranged along an arrow S direction and around of the photosensitive drum 11. The respective image forming units 12Y, 12M, 12C, 12BK form images on the photosensitive drum 11 in order using a liquid developer. On the photosensitive drum 11, an M toner image is superimposed by the second image forming unit 12M in a state in which a Y toner image is formed by the first image forming unit 12Y. A C toner image and a BK toner image formed by the third and fourth image forming units 12C, 12BK are also superimposed on already formed Y toner and M toner images in order on the photosensitive drum 11.

The respective image forming units 12Y, 12M, 12C, 12BK have basically similar constitutions except that the colors of the toners for use in the liquid developer are different. A major part of the image forming unit will be described hereinafter with reference to the first image forming unit 12Y which forms an image of yellow (Y). With regard to the other image forming units 12M, 12C, 12BK, the same components are denoted with the same reference numerals and with affixes (M, C, and BK) indicating colors, and description thereof is omitted.

The yellow (Y) image forming unit 12Y has a charging device 14Y constituted of corotron, scorotron or the like, an expose position 17Y into which a light signal (laser light) LY corresponding to the image of the Y color is guided from an expose unit 16Y (see FIG. 2), and a developing device 18Y of the Y color, which develops an exposed latent image of the Y color to form a toner image.

The respective image forming units 12 (Y, M, C, and BK) have developing devices 18 (Y, M, C, and BK) in which liquid toners containing the toners of the respective colors dispersed in carrier liquids are stored. The respective developing devices 18 (Y, M, C, and BK) are arranged at a gap of about 100 μm from the photosensitive layer (or a protective layer disposed on an outermost periphery) of the photosensitive drum 11.

Figure 2:
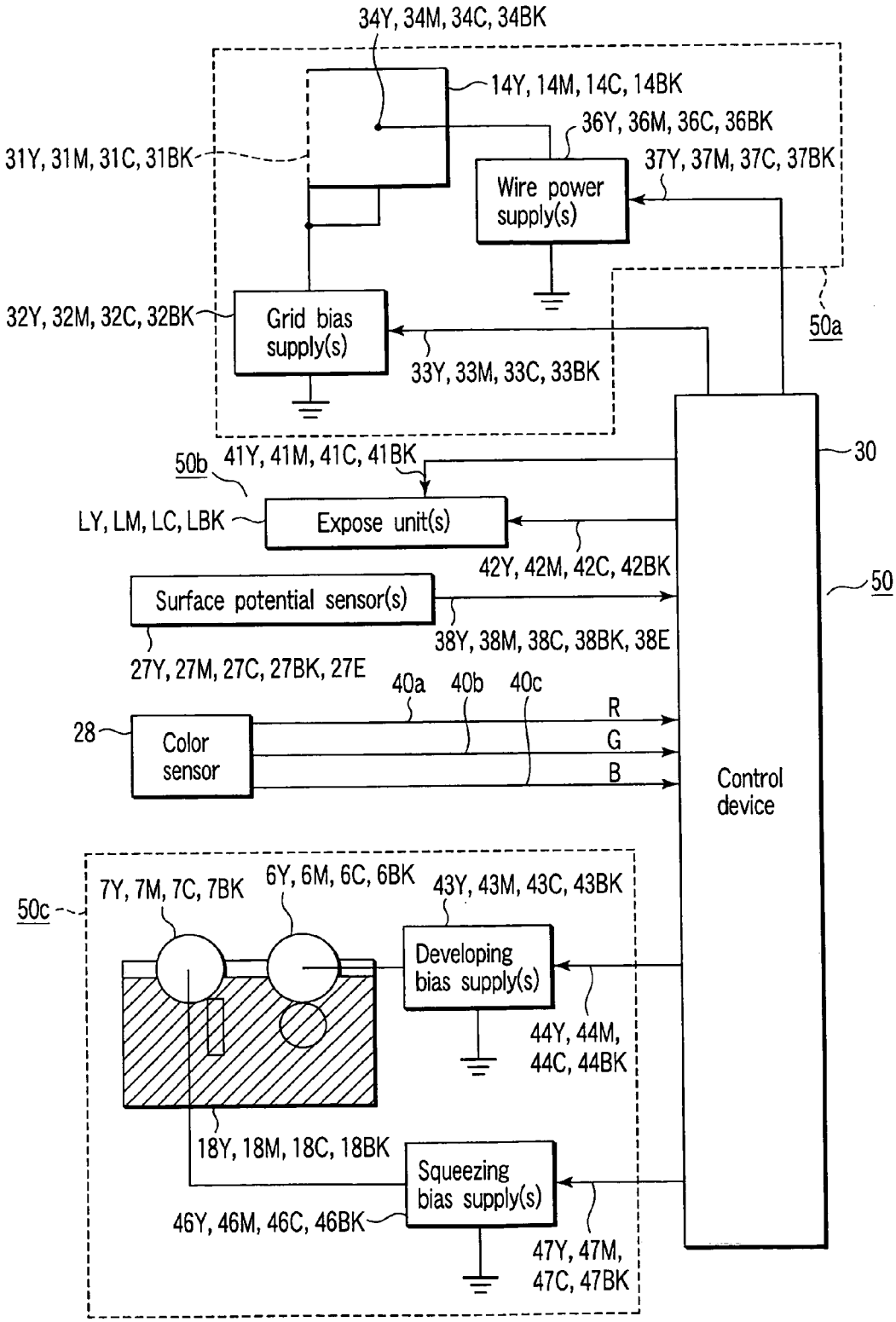
FIG. 2 is a block diagram showing one embodiment of an image maintaining control system.

As shown in FIG. 2, each of the developing devices 18 (Y, M, C, and BK) has a developing roller 6 (Y, M, C, and BK) which supplies a liquid toner to the photosensitive drum 11 to form the toner image, and a squeezing roller 7 (Y, M, C, and BK) which inhibits fogging (attaching of the toner onto a non-image region) from being caused in the developed image and which recovers a carrier liquid on the photosensitive drum 11. Each squeezing roller (Y, M, C, and BK) is disposed at a gap of about 50 μm from the photosensitive layer (or the protective layer disposed on the outermost periphery) of the photosensitive drum 11.

Around the photosensitive drum 11, a drying unit 20 is further disposed which dries developer images formed by the first to fourth image forming units 12Y, 12M, 12C, 12BK, that is, carrier liquids contained in the toner images.

Downstream with respect to the drying unit 20 on the basis of a direction in which the photosensitive drum 11 is rotated, a transfer device 22 is disposed having an intermediate transfer roller 22*b* brought into contact with the photosensitive drum 11 under pressure by a backup roller 22*a*. The backup roller 22*a* and the intermediate transfer roller 22*b* are provided with a backup cleaner 25*a*, and an intermediate member cleaner 25*b*, respectively.

Downstream with respect to the transfer device 22, a cleaner 23 which removes toner particles remaining on the photosensitive drum 11 after transferring a color image of stacked four-color toners onto a transfer member by the transfer device 22, and an erasing lamp 24 which erases remaining charges of the photosensitive layer of the photosensitive drum 11.

First to fourth surface potential sensors 27Y, 27M, 27C, and 27BK which detect surface potentials of the photosensitive drum 11 are disposed between the expose positions 17 (Y, M, C, and BK) and the first to fourth developing devices 18 (Y, M, C, and BK) of each of the first to fourth image forming unit (Y, M, C, and BK).

A last-stage surface potential sensor 27E which detects the surface potential of the photosensitive drum 11 of a four-color image forming end position is disposed downstream with respect to the developing device 18BK of the fourth image forming unit 12BK.

The respective surface potential sensors 27 (Y, M, C, BK, and E) are arranged preferably at equal distances (intervals) on the outer periphery of the photosensitive drum 11.

A color sensor 28 which detects the color image (identifies the color) formed on the photosensitive drum 11 is disposed downstream with respect to the drying unit 20 around the photosensitive drum 11.

As shown in FIG. 2, the surface potential sensors 27 (Y, M, C, BK, and E) and the color sensor 28 are connected to a control device 30 of an image quality maintaining control system 50. The control device 30 includes, for example, a CPU, personal computer or the like which controls the whole full-color electrophotographic apparatus. The control device 30 is connected to a charging device control system 50*a* which controls the charging device 14 (Y, M, C, and BK) of the image forming section 10, an exposing device control system 50*b* which controls the expose unit 16Y, 16M, 16C and 16BK (generates expose light L(Y, M, C, and BK)), and a developing device control system 50*c* which controls the developing device 18 (Y, M, C, and BK).

Each of the surface potential sensor 27 (Y, M, C, and BK) detects the surface potentials at a positions apart from a predetermined distance upstream side of each of the developing positions of the developing device 18 (Y, M, C, and BK) of the corresponding color. Each of the surface potential sensor 27 (M, C, and BK) and the surface potential sensor 27E detects the surface potentials at a positions apart from a predetermined distance upstream side of each of the developing positions of the developing device 18 (M, C, and BK) of the previous colors in the second to fourth image forming units 12 (M, C, and BK) and at a position downstream apart from a predetermined distance from the developing position of the developing device 18BK.

A predetermined voltage adjusted by a wire power supply 36 (Y, M, C, and BK) is applied to a wire 34 (Y, M, C, and BK) of each charging device 14 (Y, M, C, and BK). A direct-current constant current power supply is also usable in the power supply 36 (Y, M, C, and BK) in order to stabilize discharging.

A grid voltage having a predetermined magnitude is applied to each grid electrodes 31 (Y, M, C, and BK) of the charging device 14 (Y, M, C, and BK) via a grid bias supply 32 (Y, M, C, and BK).

The respective surface potential sensors 27 (Y, M, C, BK, and E) input surface potential signals 38 (Y, M, C, and BK) and 38E which are detection results of the potential of the surface of the corresponding photosensitive drum 11 into the control device 30.

The color sensor 28 inputs signal values 40*a*, 40*b*, 40*c* of RGB into the control device 30.

The charging device control system 50*a* maintains a discharging potential supplied to the photosensitive drum 11 from the charging device 14 (Y, M, C, and BK), that is, a charging voltage of the whole surface of the photosensitive layer of the photosensitive drum 11 at a defined value for controlling the voltage to be constant. That is, the charging device control system 50*a* corrects shifts of the surface potential of the photosensitive drum 11 charged by the discharging by the charging device 14 (Y, M, C, and BK) from a defined developing reference value in the position of the developing device 18 (Y, M, C, and BK) because of environmental changes or secular changes for age based.

The charging device control system 50*a* outputs grid bias voltage control signals 33 (Y, M, C, and BK) and wire voltage control signals 37 (Y, M, C, and BK) from the control device 30, respectively. The grid bias voltage control signals 33 (Y, M, C, and BK) are utilized in controlling outputs of the grid bias supplies 32 (Y, M, C, and BK) connected to the each of grid electrodes 31 (Y, M, C, and BK) of the charging devices 14 (Y, M, C, and BK). The wire voltage control signals 37 (Y, M, C, and BK) are utilized in controlling outputs of the wire power supplies 36 (Y, M, C, and BK) connected to the wires 34 (Y, M, C, and BK) of the charging devices 14 (Y, M, C, and BK).

As described later, the charging device control system 50*a* controls the charging devices 14 (Y, M, C, and BK) in an IOI process to suppress a phenomenon that the surface potential of the photosensitive drum 11 gradually increases as shown by a dotted curve b of FIG. 4. The charging device control system 50*a* performs a control in such a manner that the surface potentials of the photosensitive drum 11 charged by the four-color charging devices 14 (Y, M, C, and BK) are equal as shown by a curve a of FIG. 4.

The exposing device control system 50*b* controls an expose power (output of laser) by the expose unit 16 (Y, M, C, and BK) n such a manner that the surface potential of the photosensitive drum 11 after the expose is constant irrespective of the environmental changes or changes with time. The intensity of each of the laser light L (Y, M, C, and BK) of the expose unit 16 (Y, M, C, and BK) is further reflected in the results of the control of the surface potential of the photosensitive drum 11 by the charging device control system 50*a* (charging control and expose control are constantly combined/used).

The exposing device control system 50*b* controls a pulse width of laser light L (Y, M, C, and BK) of the expose unit 16 (Y, M, C, and BK) by a pulse width control signal 41 (Y, M, C, and BK) which is a digital signal, for example, of eight bits, or controls the strength of the laser light L (Y, M, C, and BK) of the expose unit 16 (Y, M, C, and BK) by a light strength control signal 42 (Y, M, C, and BK) which is an analog voltage signal through the control device 30.

The exposing device control system 50*b* controls the surface potential of a region in which the image of the photosensitive layer of the photosensitive drum 11 is exposed in the position of the developing device 18 (Y, M, C, and BK) into a defined expose reference value.

The developing device control system 50*c* controls a developing bias voltage of the developing roller 6 (Y, M, C, and BK) and/or a squeezing bias voltage of the squeezing roller 7 (Y, M, C, and BK). The developing bias voltage and/or the squeezing bias voltage corrects the shift of the density of the toner image from a defined value independently of the controls of the surface potential and expose strength by the charging device control system 50*a* and the exposing device control system 50*b*. This is because the shift of the density of the toner image from the defined value is caused, for example, by a change of the toner density in the liquid developing toner, a change of a supply amount of the liquid developing toner and the like. These changes are caused by the environmental changes.

The developing device control system 50*c* controls developing bias power supplies 43 (Y, M, C, and BK) connected to the developing rollers 6 (Y, M, C, and BK) of the developing devices 18 (Y, M, C, and BK) by developing bias control signals 44 (Y, M, C, and BK) through the control device 30. The developing device control system 50*c* controls squeezing bias power supplies 46 (Y, M, C, and BK) connected to the squeezing rollers 7 (Y, M, C, and BK) of the developing devices 18 (Y, M, C, and BK) through the control device 30 by squeezing bias control signals 47 (Y, M, C, and BK).

Next, an image forming process to form the toner images of the respective colors in the image forming section 10 will be described. Following rotation of the photosensitive drum 11 in an arrow S direction by image forming start, the photosensitive drum 11 is charged by the charging device 14Y of the yellow (Y) image forming unit 12Y. Next, a laser light LY is applied from the expose unit 16Y in accordance with image information to form an electrostatic latent image corresponding to a yellow (Y) image.

The yellow (Y) toner image is formed on the photosensitive drum 11, when the electrostatic latent image on the photosensitive drum 11 is developed by the developing device 18Y.

Similarly, magenta (M), cyan (C), and black (BK) toner images are formed in order on the photosensitive drum 11 by the second to fourth image forming units 12M, 12C, 12BK. The magenta (M) toner image is superimposed upon the previously formed yellow (Y) toner image, the cyan (C) toner image is superimposed upon the previously formed yellow (Y) and magenta (M) toner images, the black (BK) toner image is superimposed upon the already formed yellow (Y), magenta (M), and cyan (C) toner images in order, and a full-color toner image is formed.

The full-color toner image on the photosensitive drum 11 is dried by the drying unit 20, thereafter transferred (primary transfer) onto the intermediate transfer roller 22*b* pressed into contact with the photosensitive drum 11 by a load of the backup roller 22*a*, and further transferred (secondary transfer) onto a sheet P conveyed in an arrow t direction in the transfer device 22.

After end of the transfer of the toner images, residual toners (toner particles) remaining on the photosensitive drum 11 are removed by the cleaner 23. Subsequently, residual charges remaining on the photosensitive layer of the photosensitive drum 11 are erased by the erasing lamp 24.

Prior to the image forming process, in the image forming section 10, the surface potentials of the photosensitive drum 11 by changes of discharging characteristics of the charging devices 14 (Y, M, C, and BK) depending on the environmental changes and changes with time, an amount (surface potential) of charges supplied to the photosensitive drum 11, changes of attenuation characteristics of the charges of the photosensitive drum 11 or the like are detected. The charging devices 14 (Y, M, C, and BK) or the expose lights L (Y, M, C, and BK) output from the expose unit 16 (Y, M, C, and BK) are controlled based on the detected surface potentials in such. a manner that density or color of the toner image can be maintained in a certain range.

Next, an image maintaining process will be described in detail.

Figure 3:
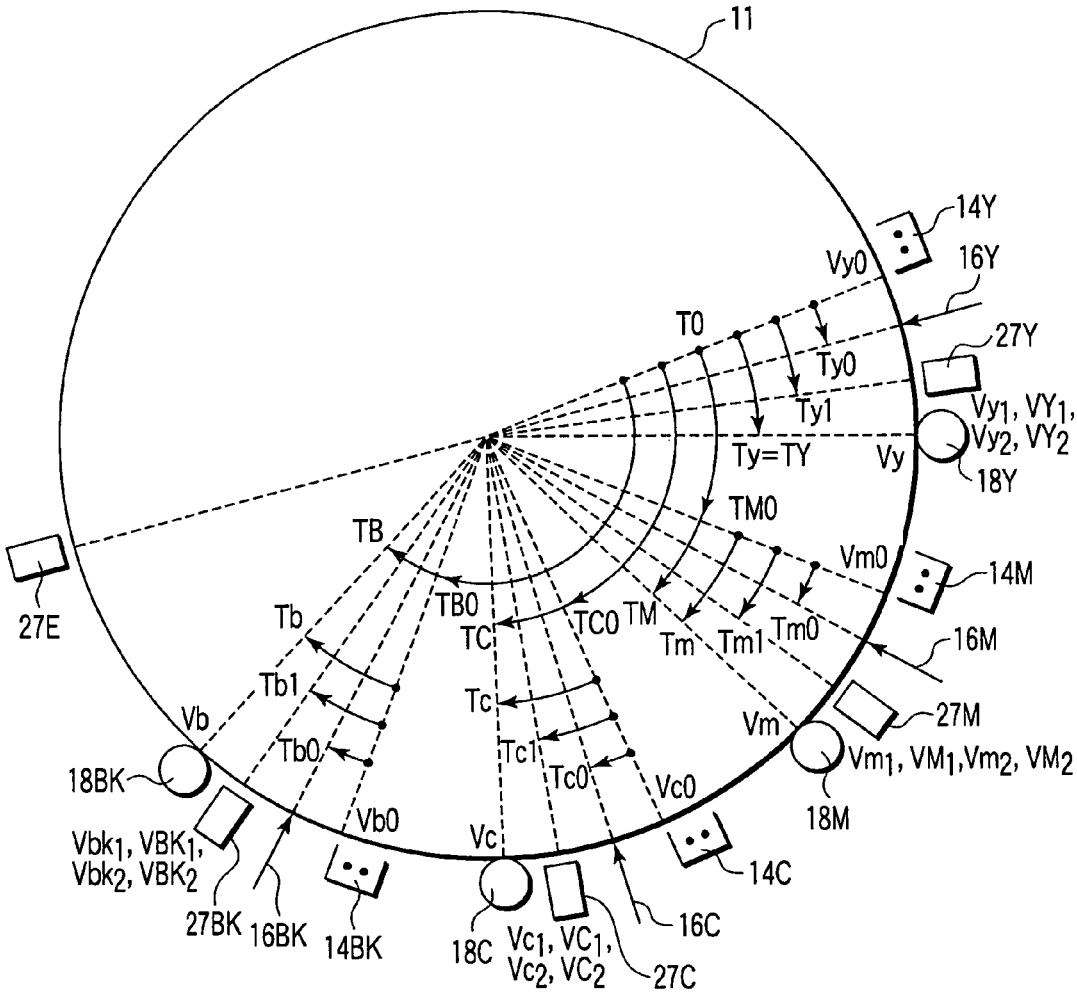
FIG. 3 is a schematic diagram showing one embodiment of arrangement of image forming units around a photosensitive drum in a time series.

The charging devices 14 (Y, M, C, and BK), the expose position 17 (Y, M, C, and BK), the surface potential sensors 27 (Y, M, C, BK, and E), and the developing devices 18 (Y, M, C, and BK) are arranged around the photosensitive drum 11 in accordance with a time series as shown in FIG. 3. For example, in the first image forming unit 12Y which is a forming section of a yellow image, elapse of time from the charging till the developing will be described as follows.

The photosensitive drum 11 is charged at a surface potential $Vy_0$ by the charging device 14Y at time $T_0$. A position after the elapse of time $Ty_0$ corresponds to that of the expose position 17Y. In a position after the elapse of time $Ty_1$ from the time $T_0$, the surface potential sensor 27Y is disposed to detect the surface potential of the developing device 18Y before the developing.

Detected potentials in this position, which are detection results before the developing are $Vy_1$ at the time of non-expose, and $VY_1$ at the time of the expose.

The developing device 18Y is disposed in a position after the elapse of time Ty from the time $T_0$. The surface potential which is a predicted value in the position indicates Vy at the time of the non-expose, and VY at the time of the expose.

This also applies to the second to fourth image forming units 12 (M, C, and BK).

In the second to fourth image forming units 12 (M, C, and BK), detected values $Vy_2$, $Vm_2$, $Vc_2$, or $VY_2$, $VM_2$, $VC_2$ of the surface potentials of the latent image fomed by the previous image forming unit pass throuh the position for detecting the surface potentials of the surface potential sensors 27 (M, C, and BK), each positioned at a downstream side of each of the developing device 18 (M, C, and BK).

In the fourth image forming unit 12BK, the photosensitive drum 11 is charged at a surface potential $Vbk_0$ by the charging device 14BK at a time $TB_0$. The last surface potential sensor 27E is disposed in a position after the elapse of time $Tb_2$. After passage through the black (BK) developing device 18BK, a detected value $Vbk_2$ or $VBK_2$ of the surface potential which is the detection result is detected.

A time from the first charging position (time $T_0$) till the yellow developing device 18Y is indicated by Ty (equal to TY). Similarly, a time from a time $TM_0$ for the charging for magenta till the developing of magenta is indicated by Tm (TM, denote a time period from the time $T_0$ to the time TM), and a time from a time $TC_0$ for the charging for cyan till the developing of cyan is indicated by Tc (TC, denote a time period from the time $T_0$ to the time TC). A time from a time $TB_0$ for the charging for black till the developing of black is Tbk (TBK, denote a time period from the time $T_0$ to the time TBK).

Figure 4:
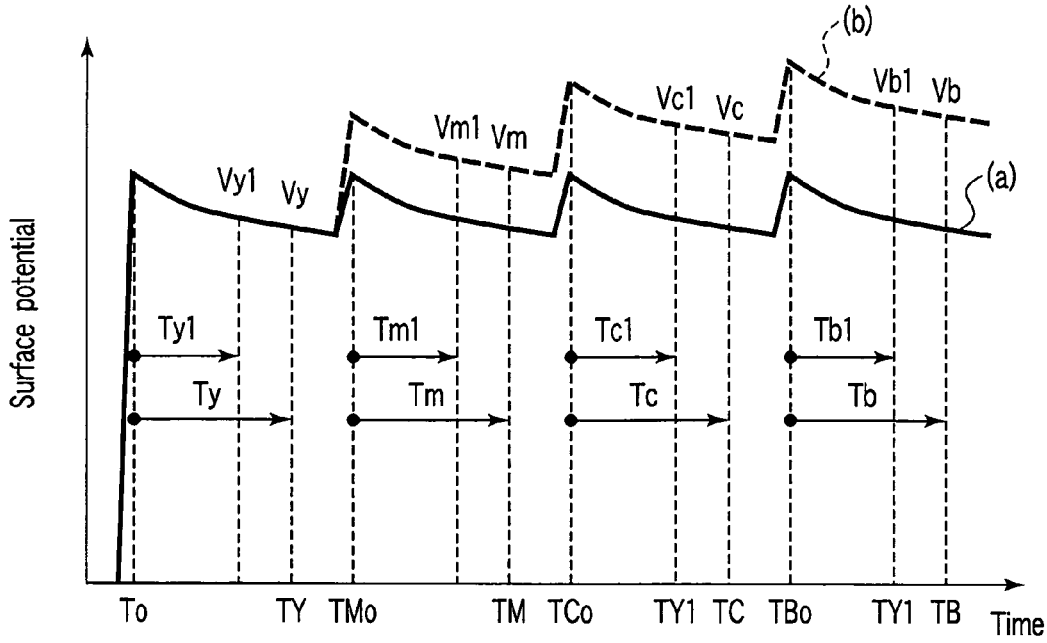
FIG. 4 is a schematic diagram showing one example of a surface potential in a case where the photosensitive drum is charged in an IOI process.

FIG. 4 shows an example of a change of the surface potential with time in a case where capabilities of the individual charging devices 14 (Y, M, C, and BK) of the first to fourth image forming units 12 (Y, M, C, and BK) are set to be equal, and the photosensitive drum 11 is continuously charged at the equal wire voltage and grid voltage in the IOI process.

When the charging of yellow ends, the photosensitive drum 11 is charged at $Vy_0$ at the time $T_0$. Thereafter, the potential successively drops by dark decay, and $Vy_1$ is obtained as the detection result before the developing in a surface potential sensor 27Y position. When the developing device 18Y is reached after the elapse of TY time, the surface potential is attenuated to Vy, and continuously attenuated till the charging of the next color.

When the charging for magenta ends at time $TM_0$, the photosensitive drum 11 is charged at a surface potential $Vm_0$. That is, the yellow is charged from a surface potential state of 0 V, whereas the magenta is charged from an already charged state for Y image. The surface potential $Vm_0$ of the photosensitive drum 11 after the magenta charging is larger than $Vy_0$ for a first color. Therefore, the surface potential Vm at a magenta developing time TM is larger than the surface potential Vy at a yellow developing time TY.

Similarly, at the end of the charging each for third-color cyan and fourth-color black, as shown by a dotted curve b of FIG. 4, the surface potential of the photosensitive drum 11 is gradually raised.

In this state, when the expose strength of each of the expose unit 16 (Y, M, C, and BK) is set to be constant, and the developing bias voltage of the developing roller 6 (Y, M, C, and BK) is set to be constant, the developing contrast of the toner image decreases toward the image forming unit of a rear stage, and an image density decreases.

Additionally, a rise of the surface potential caused by repetition of an image forming process is not constant, and actually constantly changes by attenuation characteristics by environmental conditions or history of image forming of the photosensitive member, differences of charging characteristics among the respective charging devices 14 (Y, M, C, and BK), or changes with time by deterioration of performances (age-based secular changes) during the use of these devices.

To prevent this phenomenon and to maintain the image quality, in the image maintaining process of the present embodiment, the charging devices 14 (Y, M, C, and BK) and the expose unit 16 (Y, M, C, and BK) are controlled.

The charging devices 14 (Y, M, C, and BK) are controlled based on the surface potentials Vy, Vm, Vc, Vbk of unexposed portions in the positions of the developing devices 18 (Y, M, C, and BK). The surface potentials (unexposed portions) Vy, Vm, Vc, Vbk are predicted values obtained from dark decay characteristics of the photosensitive drum 11 obtained based on surface potentials $Vy_1$, $Vy_2$, $Vm_1$, $Vm_2$, $Vc_1$, $Vc_1$, $Vc_2$, $Vbk_1$, $Vbk_2$ which are detection results before and after the developing, detected by the surface potential sensors 27 (Y, M, C, BK, and E) disposed before/after the developing devices 18 (Y, M, C, and BK).

The intensity of the expose lights L (Y, M, C, and BK) output from the expose unit 16 (Y, M, C, and BK) are controlled in accordance with surface potentials VY, VM, VC, VBK at the time of the expose in the positions of the developing devices 18 (Y, M, C, and BK). The surface potentials VY, VM, VC, VBK at the time of the expose are predicted values obtained from the dark decay characteristics of the photosensitive drum 11 obtained from surface potentials $VY_1$, $VY_2$, $VM_1$, $VM_2$, $VC_1$, $VC_2$, $VBK_1$, $VBK_2$ at the time of the expose detected by the surface potential sensors 27 (Y, M, C, BK, and E) disposed before/after the respective developing devices 18 (Y, M, C, and BK).

Figure 5:
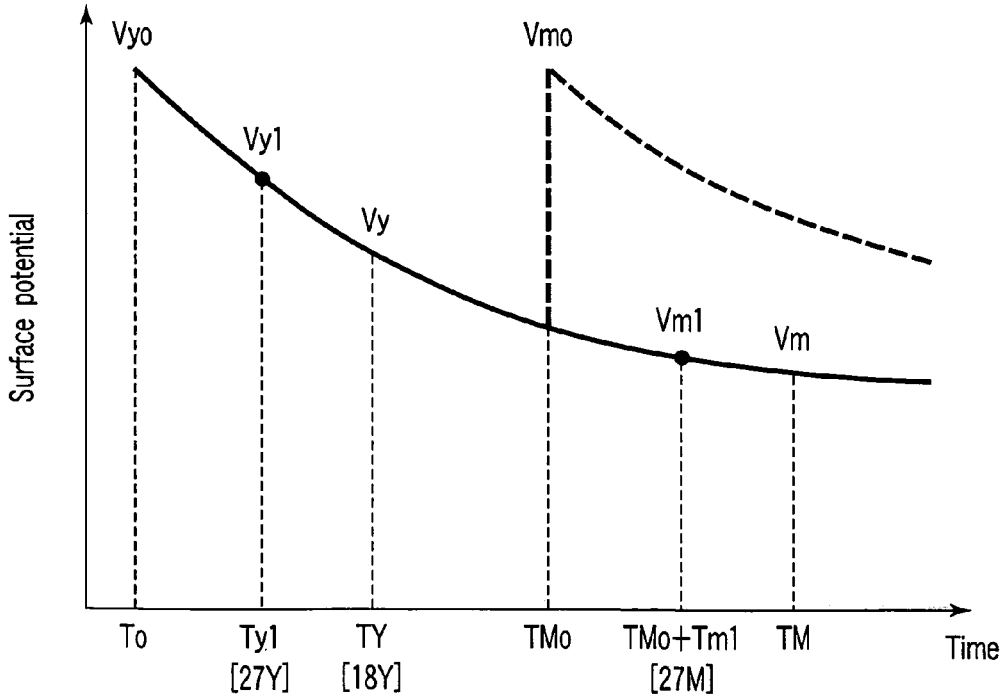
FIG. 5 is a schematic diagram showing one example in which a predicted value is estimated from attenuation characteristics of the photosensitive drum.

First, estimating of the predicted value, for example, in the image forming unit 12Y of yellow which is a first color will be described. As shown in FIG. 5, the charging is started at time $T_0$, and the surface potential of the photosensitive drum 11 indicates $Vy_0$. In the position of the surface potential sensor 27Y after the elapse of time $Ty_1$, the surface potential $Vy_1$ is detected. Thereafter, after the elapse of time TY and after passage through the developing device 18Y position(, re-charging by second-color magenta is not performed). In the surface potential sensor 27M position after the elapse of time $YM_0+Tm_1$, the surface potential is attenuated to $Vm_1$ by the dark decay of the photosensitive drum 11.

A surface potential to be actually detected is Vy in the developing device 18Y position. Therefore, the surface potential Vy in the developing device 18Y position is estimated as the predicted value from the surface potential $Vy_1$ detected by the surface potential sensor 27Y and the surface potential $Vm_1$ detected by the surface potential sensor 27M.

In the estimating method, even when $Vy_1$ and $Vm_1$ are linearly approximated, an error that raises a problem is not generated. However, in the photosensitive member having large dark decay, such as amorphous silicon, more correct values are obtained by approximation using a smooth curve without any inflection point, such as index approximation.

The charging device 14Y is controlled in such a manner that the estimated surface potential Vy in the developing device 18Y position indicates a certain developing reference value suitable for the developing.

In the control of the charging device 14Y, the grid bias supply 32Y is controlled by the grid bias control signal 33Y, and the wire power supply 36Y is controlled by the wire voltage control signals 37Y.

Next, estimation of the predicted value after the expose in the image forming unit 12Y of the first-color yellow will be described.

Figure 6:
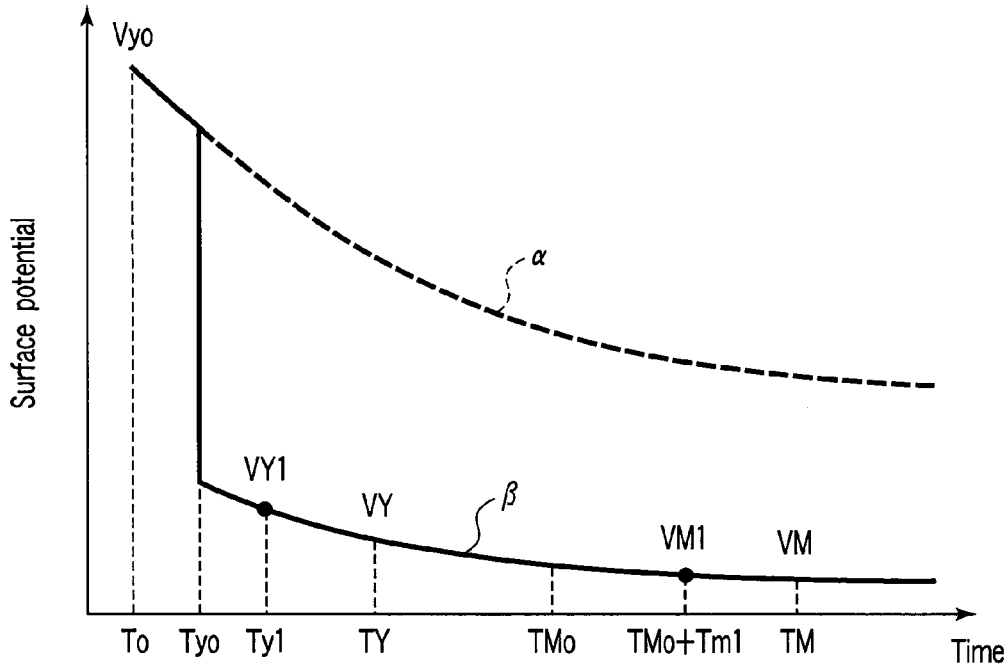
FIG. 6 is a schematic diagram showing one example in which a predicted value after expose is estimated from the attenuation characteristics of the photosensitive drum.

As shown in FIG. 6, in the photosensitive drum 11, the unexposed portion is subjected to the dark decay from a state of the surface potential $Vy_0$ by the charging as shown by a dotted curve α. The exposed portion exposed by the expose unit 16Y in the expose position 17Y after the elapse of time $Ty_0$ as shown by a curve β, the surface potential is once lowered, and thereafter the dark decay is performed again. Here, the surface potential to be actually detected is VY of the exposed portion, which is the surface potential once lowered by the expose, in the developing device 18Y position as shown by the curve β. Therefore, the surface potential VY of the developing device 18Y position is estimated from the surface potential $VY_1$ detected by the surface potential sensor 27Y and the surface potential $VM_1$ detected by the surface potential sensor 27M.

In the estimating method, since the dark decay is smaller than that of the unexposed portion shown by the dotted curve α, considerably satisfactory approximation is obtained even by linear approximation of $Vy_1$ and $Vm_1$. More preferably, further correct value is obtained by approximation using a smooth curve without any inflection point, such as index approximation, in the same manner as in the unexposed portion.

When the surface potential VY of the exposed portion in the developing device 18Y position is estimated, a sufficiently satisfactory value is obtained by the linear approximation of $VY_1$ and $VM_1$. Furthermore, if the estimation is simplified, and a value of $VY_1$ or $VM_1$ is used as the value of VY, any problem is not caused in many cases. As shown by the curve β, the dark decay of the exposed portion is considerably small. Especially in the expose in the vicinity of a saturated potential in a binary image or the like, the dark decay is very small, and therefore it is also possible to estimate one of $VY_1$ detected by the surface potential sensor 27Y and $VM_1$ detected by the surface potential sensor 27M as such as the surface potential in the developing device 18Y.

The expose intensity of the light LY exposed by the expose unit 16Y is controlled in such a manner that the estimated surface potential VY in the developing device 18Y position indicates a certain expose reference value suitable for the expose. The expose light LY from the expose unit 16Y is controlled by a change of a pulse width of laser light by the pulse width control signal 41 (Y, M, C, and BK) or a change of the intensity of the laser light by the light intensity control signal 42 (Y, M, C, and BK). Similarly, the charging devices 14 (M, C, and BK) or the expose lights L (M, C, and BK) from the expose unit 16 (M, C, and BK) of the image forming units 12 (M, C, and BK) of second and subsequent colors are controlled. Since the surface potential sensors 27 (Y, M, C, BK, and E) are arranged at the equal intervals, the same approximation equation is usable in approximating the surface potentials VY, VM, VC, VBK in the respective positions of the image forming units 12 (Y, M, C, and BK) and developing devices 18 (Y, M, C, and BK).

When the color images are superimposed on the photosensitive drum 11 in an IOI system, the surface potentials in the next charging differ with respect to the exposed and unexposed portions at the time of the image forming process of the previous stage. Therefore, especially to form a halftone image or the like whose image quality is influenced by a slight fluctuation of the surface potential of the photosensitive drum 11, at the time of the image forming process for the second and subsequent colors, outputs (i.e., the surface potentials in the respective developing positions of the photosensitive drum 11) of the charging devices 14 (M, C, and BK) or the intensities of the expose lights L (M, C, and BK) from the expose unit 16 (M, C, and BK) may be controlled in consideration of the expose history of the photosensitive drum 11 by the image forming process of the previous stage.

Principles to control the charging devices 14 (M, C, and BK) or the expose lights L (M, C, and BK) from the expose unit 16 (M, C, and BK) for the second and subsequent colors in consideration of the expose history of the photosensitive drum will be described in detail.

Figure 7:
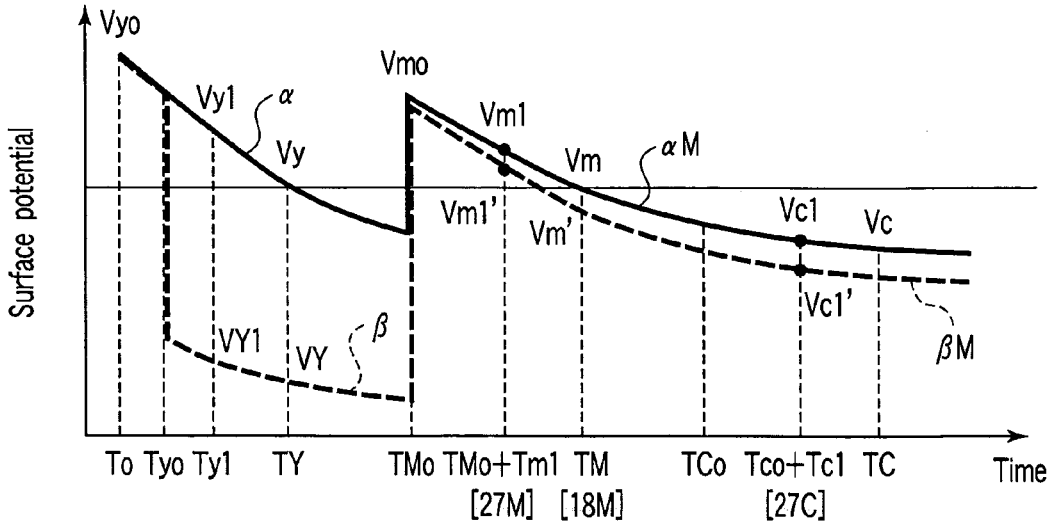
FIG. 7 is a schematic diagram showing one example of control of an exposing device in consideration of expose history of a previous color.

When the photosensitive drum 11 is charged by the charging device 14M at time $TM_0$ by the image forming process of the second-color magenta, as shown in FIG. 7, the dark decay of the unexposed portion which is not exposed at the time of the image forming process of the first-color yellow and which indicates drop characteristics shown by the curve α is shown by a curve αM. On the other hand, the dark decay of the exposed portion which is exposed at the time of the image forming process of the first-color yellow and which indicates drop characteristics shown by the dotted curve β is shown by a dotted curve βM.

That is, at the time of the charging at the position by the charging device 14M, the surface potential of the unexposed portion in the yellow image forming process of the previous stage is Vm, whereas the surface potential of the exposed portion is Vm', and a potential difference is generated. The potential difference between Vm and Vm' is about several tens of volts to 200 V depending on environments.

Next, measurement of the potential difference between Vm and Vm' caused by the charging for the second color, and reduction of the potential difference will be described.

First, in the same manner as in the charging control for the first-color yellow, the surface potential Vm of the unexposed portion having the dark decay shown by the curve αM in FIG. 7 in the developing device 18M position is estimated using the surface potential sensors 27M and 27C. That is, Vm is estimated from $Vm_1$ detected by the surface potential sensor 27M and $Vc_1$ detected by the surface potential sensor 27C by linear approximation, index approximation or the like. The charging device 14M is controlled in such a manner that the estimated surface potential Vm in the developing device 18M position indicates a certain developing reference value suitable for the developing. To control the charging device 14M, the grid bias supply 32M is controlled by the grid bias control signal 33M, or the wire power supply 36M is controlled by the wire voltage control signal 37M. At this time, first, the grid bias supply 32M is preferably controlled to change and control the grid voltage.

In this manner, the control in a case where the unexposed portion in the first color is charged by the charging device 14M for the second color is completed.

Next, a degree of the charging of the exposed portion in the first color by the charging device 14M for the second color is measured.

At the time of the image forming process for the first color, the photosensitive drum 11 is exposed on expose conditions controlled by the expose unit 16Y, after the charging on predetermined conditions controlled by the charging device 14Y.

Next, the photosensitive drum 11 is charged by the charging device 14M for the second color. The dark decay of the surface potential of the photosensitive drum 11 is shown by the dotted curve βM in FIG. 7.

Thereafter, Vm' is estimated from the surface potentials $Vm_1'$ and $Vc_1$ detected using the surface potential sensors 27M and 27C by the linear approximation, index approximation, or the like. When the potential difference between Vm and Vm' is within a predetermined range (e.g., 100 V or less), the control of the charging device 14M is ended.

When the potential difference between Vm and Vm' is larger than the predetermined range (100 V or less), the control of the charging device 14M is further repeated until the potential difference between Vm and Vm' falls within the predetermined range, preferably reaches 50 V or less. In general, when the grid voltage is changed, not only Vm' but also Vm close to a saturated potential change. Therefore, in the control of the charging device 14M, for example, a wire voltage or a wire current is increased in the wire power supply 36M by the wire control signal 37M, the value of Vm' is increased further as compared with Vm, and accordingly the potential difference between Vm and Vm' is reduced. That is, an operation of controlling the grid voltage in the grid bias supply 32M to control the sectional view Vm of the unexposed portion and controlling the wire voltage in the wire power supply 36M to control the surface potential Vm' of the exposed portion is repeated until the potential difference between Vm and Vm' falls within the predetermined range.

The similar operation is repeated also in the image forming processes for the third and fourth colors, and the charging devices 14C and 14BK may be controlled in consideration of the expose history of the photosensitive drum 11. In the third-color image forming process, the surface potential in the developing device 18C position is estimated using the surface potential sensors 27C and 27BK, and in the fourth-color image forming process, the surface potential in the developing device 18BK position is estimated using the surface potential sensors 27BK and 27E.

When the each of the expose unit 16 (Y, M, C, and BK) is controlled in consideration of the expose history of the photosensitive drum 11, the expose of the image forming process of the previous stage influences the charging of the next stage, but the expose of the image forming process of a stage before the previous stage hardly influences the charging of the next stage. Therefore, it is sufficient to consider the expose of the image forming process of the previous stage in controlling the expose unit 16 (Y, M, C, and BK).

For example, in the magenta second image forming unit 12M in the second and subsequent colors, the charging device 14M may be controlled in such a manner that the surface potential Vm' of the portion exposed in the first color, having the dark decay characteristics shown by the dotted curve βM in FIG. 7 in the developing device 18M position indicates a certain developing reference value suitable for the developing. Even when the surface potential Vm' of the portion exposed in the first color is controlled into the developing reference value in this manner, thereafter the control of the grid and wire voltages is repeated until the potential difference between the surface potential Vm of the unexposed portion in the first color and the surface potential Vm' of the exposed portion falls within the predetermined range.

The estimating of the predicted value after the expose in the image forming unit 12M for the second-color magenta is performed in the same manner as in the first-color yellow.

With regard to the surface potential once lowered at the time of the expose of the second color, the surface potential differs in the portions exposed or unexposed at the time of the image forming process of the first color, but the difference is not very large. Therefore, a small-density portion is slightly influenced in a halftone image. However, in an image which is close to a binary image, since the potentials of both the exposed and unexposed portions are lowered substantially to saturated potentials, the image quality is hardly influenced.

In the image forming processes for the third and fourth colors, the similar operation is repeated, and the each of the expose unit 16C and 16BK is controlled. In the third-color image forming process, the predicted value after the expose is estimated using the surface potential sensors 27C and 27BK. In the fourth-color image forming process, the predicted value after the expose is estimated using the surface potential sensors 27BK and 27E.

Figure 8:
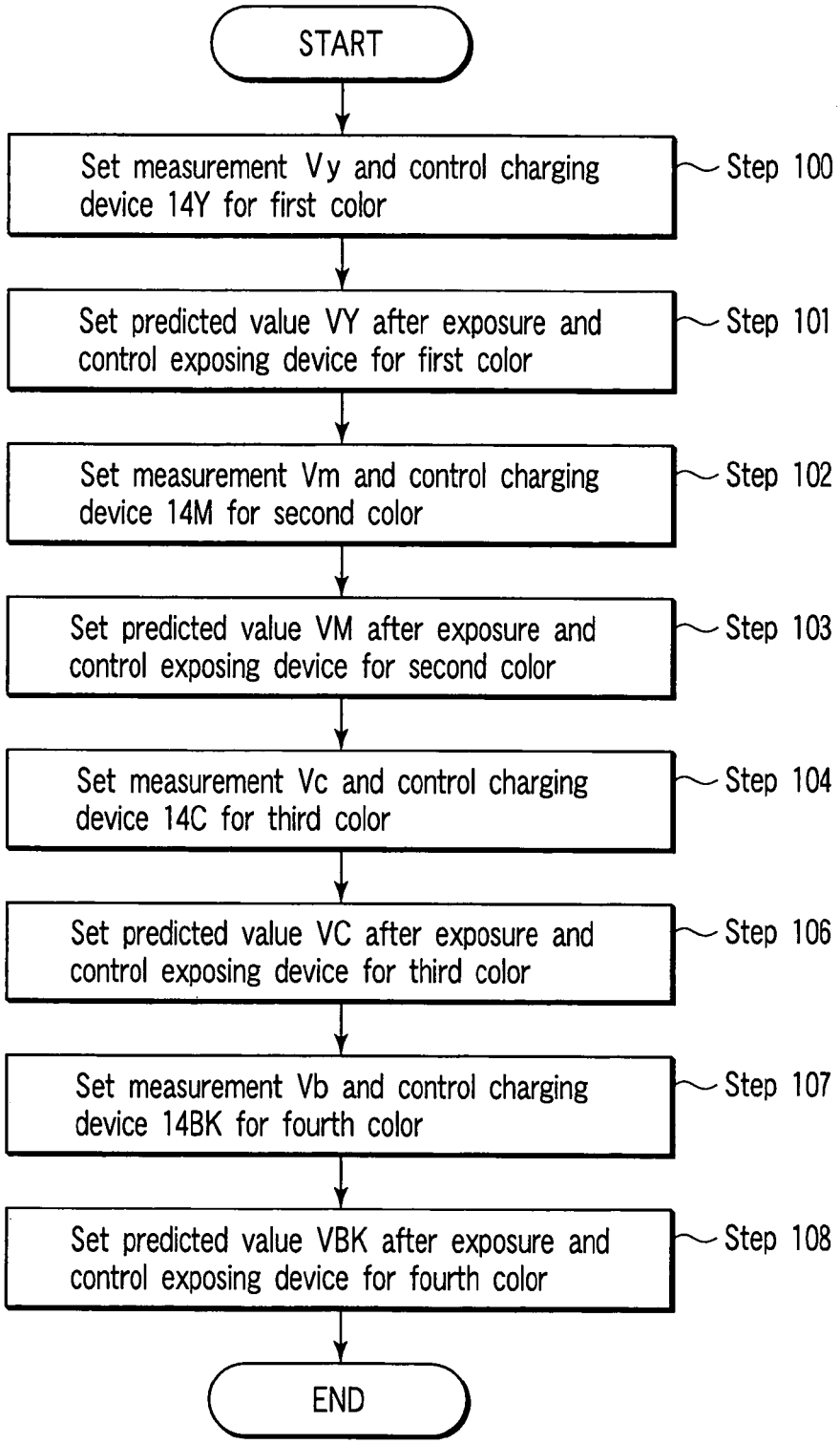
FIG. 8 is a flowchart showing one example of an image maintaining process.

An example of the controlling of the charging devices 14 (Y, M, C, and BK) and the expose unit 16 (Y, M, C, and BK) based on the above-described principles will be described with reference to a flowchart of FIG. 8.

When the image maintaining process is started, in step 100, the first-color charging device 14Y is controlled. The first-color yellow charging device 14Y only is operated to charge the photosensitive drum 11. Thereafter, without performing the expose, the detection result before the developing is, at a position apart from a predetermined distance upstream side of the developing position, detected by the first-color surface potential sensor 27Y, the detection result after the developing is, at a positions apart from a predetermined distance upstream side of the developing position, detected by the second-color surface potential sensor 27M, and the predicted value Vy of the unexposed portion is estimated. The charging device 14Y is controlled in such a manner as to set the predicted value Vy to a certain developing reference value.

Next, in step 101, after charging the photosensitive drum 11 by the charging device 14Y at the value controlled in the step 100, the expose of the first color is performed by the expose unit 16Y, the detection result before the developing of the photosensitive drum 11 is detected by the first-color surface potential sensor 27Y, the detection result after the developing is detected by the second-color surface potential sensor 27M, and the predicted value VY after the expose is estimated. The expose unit 16Y is controlled in such a manner that the predicted value VY after the expose indicates a certain expose reference value, and an expose light amount of the first-color is controlled;

Next in step 102, the second-color charging device 14M is controlled. The charging device 14Y is driven by the value controlled in the step 100, and further the charging device 14M of the second-color magenta is operated. That is, after the charging the photosensitive drum 11 by the charging device 14Y, charging is performed by the charging device 14M without performing the expose.

After the charging of the charging device 14M for the photosensitive drum 11, without performing the expose, the detection result before the developing is detected by the second-color surface potential sensor 27M, the detection result after the developing is detected by the third-color surface potential sensor 27C, and the predicted value Vm of the unexposed portion in a case where the first color is not exposed is estimated. The charging device 14M is controlled in such a manner as to set the predicted value Vm to the certain developing reference value.

Next, the charging device 14Y is driven at the value controlled in the step 100 in the first image forming unit 12Y, or the expose unit 16Y is controlled at the value determined in the step 101. After charging the photosensitive drum 11 by the charging device 14Y, the expose is performed in the expose position 17Y. Next, the photosensitive drum 11 is charged by the second-color charging device 14M. After charging by charging device 14M of the photosensitive drum 11, without performing the expose, the detection result before the developing is detected by the second-color surface potential sensor 27M, the detection result after the developing is detected by the third-color surface potential sensor 27C, and the predicted value Vm' of the unexposed portion in the expose of the first color is estimated. Adjustments of the predicted value Vm in a case where the first color is not exposed and the predicted value Vm' in a case where the expose is performed are repeated in such a manner that the potential difference between Vm and Vm' falls within the predetermined range. When the potential difference between Vm and Vm' falls within a defined range, the process advances to step 103.

In step 103, after charging the photosensitive drum 11 by the charging devices 14Y and 14M controlled at the values set in the steps 100 and 102, respectively, the expose light LM of the second color is performed by the expose unit 16M, the detection result before the developing of the photosensitive drum 11 is detected by the second-color surface potential sensor 27M, the detection result after the developing is detected by the third-color surface potential sensor 27C, and the predicted value VM after the expose is estimated. The expose unit 16M is controlled in such a manner that the predicted value VM after the expose indicates the certain expose reference value, and an expose light amount of the second color is controlled.

Next, in step 104, the third-color charging device 14C is controlled. The charging devices 14Y and 14M are controlled at the values set by the steps 100 and 102, respectively, and further the charging device 14C of the third-color cyan is operated. After charging the photosensitive drum 11 by the charging devices 14Y and 14M, the charging is performed by the charging device 14C without performing the expose.

After the charging for the M image of the photosensitive drum 11, without performing the expose, the detection result before the developing is detected by the third-color surface potential sensor 27C, the detection result after the developing is detected by the fourth-color surface potential sensor 27BK, and the predicted value Vc of the unexposed portion in a case where the second color is not exposed is estimated. The charging device 14C is controlled in such a manner that the predicted value Vc indicates the certain developing reference value.

Next, in the first and second image forming units 12Y and 12M, the charging devices 14Y, 14M are controlled at the values determined in the steps 100 and 102, respectively, or the expose unit 16M is output at the value controlled in the step 103. After charging the photosensitive drum 11 by the charging device 14M, the drum is exposed in the expose position 17M. It is to be noted that since the expose history of the first color hardly influences the control of the third-color charging device 14C, the first color is controlled in an unexposed state in the present embodiment.

Next, the photosensitive drum 11 is charged by the third-color charging device 14C.

After charging for C image of the photosensitive drum 11, without performing the expose, the detection result before the developing is detected by the third-color surface potential sensor 27C, the detection result after the developing is detected by the fourth-color surface potential sensor 27BK, and a predicted value Vc' of the unexposed portion in a case where the expose is performed in the second color is estimated. Adjustments of the predicted value Vc in a case where the second color is not exposed and the predicted value Vc' in a case where the expose is performed are repeated in such a manner that the potential difference between Vc and Vc' falls within the predetermined range. When the potential difference between Vc and Vc' falls within a defined range, the process advances to step 106.

In step 106, after charging the photosensitive drum 11 by the charging devices 14Y, 14M, and 14C controlled by the values set in the steps 100, 102, and 104, respectively, the third-color expose LIGHT LC is performed by the expose unit 16C. The detection result of the photosensitive drum 11 before the developing is detected by the third-color surface potential sensor 27C, the detection result after the developing is detected by the fourth-color surface potential sensor 27BK, and a predicted value VC after the expose is estimated. The expose unit 16C is controlled in such a manner that the predicted value VC after the expose indicates the certain expose reference value, and an expose light amount of the third color is controlled.

Finally, in steps 107 and 108, the fourth-color charging device 14C and the expose light amount of the fourth color are controlled.

In the step 107, the charging devices 14Y, 14M, and 14C are controlled by the values set in the steps 100, 102, and 104, respectively, and the charging device 14BK of the fourth-color black is operated. Accordingly, after charging the photosensitive drum 11 by the charging devices 14 (Y, M, C, and BK), the drum is charged by the charging device 14BK without being exposed.

After charging the photosensitive drum 11, without performing the expose, the detection result before the developing is detected by the fourth-color surface potential sensor 27BK, the detection result after the developing is detected by the surface potential sensor 27E adjacent downstream with respect to the fourth-color developing device 18BK, and the predicted value Vbk of the unexposed portion in a case where the third color is not exposed is estimated. The charging device 14BK is controlled in such a manner that the predicted value Vbk indicates the certain developing reference value.

Next, in the first and second image forming units 12 (Y and M), the charging devices (Y and M) are driven at the values controlled in the steps 100, 102, 104, respectively, the each of the expose unit 16 (Y and M) is powered at the value controlled in the step 106, the photosensitive drum 11 is charged by the third-color charging device 14C, and thereafter the drum is exposed in the expose position 17C. Since the exposed history of the first and second colors hardly influences the control of the fourth-color charging device 14, the first and second colors are controlled in the unexposed state in the present embodiment.

Subsequently, the photosensitive drum 11 is charged by the fourth-color charging device 14BK. After charging for BK image of the photosensitive drum 11, without performing the expose, the detection result before the developing is detected by the fourth-color surface potential sensor 27BK, the detection result after the developing is detected downstream by the surface potential sensor 27E, and a predicted value Vbk' of the unexposed portion in a case where the third color is exposed is estimated. Adjustments of the predicted value Vbk in a case where the third color is not exposed and the predicted value Vbk' in a case where the expose is performed are repeated in such a manner that the potential difference between Vbk and Vbk' falls within the predetermined range. When the potential difference between Vbk and Vbk' falls within a defined range, the process advances to step 108.

In step 108, after charging the photosensitive drum 11 by the charging devices 14 (Y, M, C, and BK) controlled by the values set in the steps 100, 102, 104, and 107, respectively, the fourth-color expose light LBK is performed by the expose unit 16BK. The detection result of the photosensitive drum 11 before the developing is detected by the fourth-color surface potential sensor 27BK, the detection result after the developing is detected downstream by the surface potential sensor 27E, and a predicted value VBK after the expose is estimated. The expose unit 16BK is controlled in-such a manner that the predicted value VBK after the expose indicates the certain expose reference value, and an expose light amount of the fourth color is controlled.

In the present embodiment, properties of the toner, such as density, conductivity, and supply amount, are set to be constant as assumptions in controlling the charging devices 14 (Y, M, C, and BK) and expose unit 16 (Y, M, C, and BK). Therefore, when these values fluctuate, the color image on the photosensitive drum 11 is read by the color sensor 28, densities and developing amounts of the respective colors are detected, the detection results by the color sensor 28 are fed back to the developing bias power supplies 43 (Y, M, C, and BK) and squeezing bias power supplies 46 (Y, M, C, and BK) of the respective colors, and the properties of the toner are controlled to be constant.

As described above, the image maintaining process of the steps 100 to 108 is performed, the charging devices 14 (Y, M, C, and BK) and expose unit 16 (Y, M, C, and BK) are controlled in consideration of the environmental changes or the changes with time, and the devices are set in states capable of maintaining the image quality. Thereafter, the above-described image forming process is performed, and the full-color toner image is formed on the photosensitive drum 11 by the IOI process using the first to fourth image forming units 12 (Y, M, C, and BK), and next transferred onto the sheet P to obtain a full-color image having a desired image quality.

In the constitution, at the time of the performing of the IOI process, the predicted values Vy, Vm, Vc, Vbk which are the surface potentials of the photosensitive drum 11 in the developing device 18 (Y, M, C, and BK) positions are obtained from the detection results of the surface potentials by two surface potential sensors 27 (Y, M, C, BK, and E) disposed before/after one developing device 18 (Y, M, C, and BK) of each of the respective image forming units 12 (Y, M, C, and BK), and the charging devices 14 (Y, M, C, and BK) are controlled in such a manner that the predicted values Vy, Vm, Vc, Vbk indicate the defined developing reference values.

The predicted values VY, VM, VC, VBK after the expose in the developing device 18 (Y, M, C, and BK) positions are obtained from the detection results by two surface potential sensors 27 (Y, M, C, BK, and E) disposed before/after one developing device 18 (Y, M, C, and BK), and the expose unit 16 (Y, M, C, and BK) are controlled in such a manner that the predicted values VY, VM, VC, VBK indicate the defined expose reference values.

Therefore, the charging devices 14 (Y, M, C, and BK) and the expose unit 16 (Y, M, C, and BK) can be more correctly controlled appropriately in accordance with the attenuation characteristics of the photosensitive drum 11 irrespective of the changes of the image forming characteristics generated by the environmental changes or the changes with time, and further differences in the characteristics among a plurality of image forming units. The satisfactory color image can be manufactured in consideration of the environmental changes or the changes with time, and a color image having a high quality level can be obtained.

Additionally, in the image forming units 12 (M, C, and BK) of the second and subsequent colors, the charging devices 14 (M, C, and BK) can be controlled in consideration of the charging histories by the charging devices 14 (Y, M, and C) of the previous colors, respectively. Therefore, color reproducibility can be enhanced even at the time of the forming of the halftone image, and satisfactory image maintaining can be achieved after the high-quality color image formation.

Two of the surface potential sensors 27 (Y, M, C, and BK) and the surface potential sensor 27E downstream of the last image forming unit 12BK disposed in the respective image forming units 12 (Y, M, C, and BK) are combined/used every time. The predicted values Vy, Vm, Vc, Vbk which are the surface potentials of the photosensitive drum 11 in the developing device 18 (Y, M, C, and BK) positions, and predicted values VY, VM, VC, VBK after the expose are obtained. Therefore, the number of the surface potential sensors necessary for controlling the charging devices 14 (Y, M, C, and BK) and expose unit 16 (Y, M, C, and BK) can be saved, and cost of the apparatus can be reduced.

The present invention is not limited to the above-described embodiment, and can be modified without changing the scope. The structure of the color image forming apparatus or the like is not limited. The present invention may be applied, for example, to a dry type color image forming apparatus, and an LED lamp may be used in the exposing device. Similarly, timings for performing the control in order to maintain the image are arbitrary, such as a starting time of the color image forming apparatus, a start time of a new job, or any necessary time.

The plurality of surface potential sensors which detect the surface potentials of the photosensitive member before/after the developing device do not have to be arranged at the equal intervals. In the above-described embodiment, when the charging device is controlled in consideration of the expose history by the exposing device of the color of the previous stage, the potential difference between the exposed and unexposed portions by the exposing device of the previous stage, requiring the adjustments, is not limited, and is arbitrary in accordance with the influence onto an image such as a halftone image.

What is claimed is:

1. A color image forming apparatus comprising:

a photosensitive member having a photosensitive layer and capable of holding a plurality of developed color images;

a plurality of image forming units arranged around the photosensitive member, each having a charging device, an expose device, and a developing device, each image forming unit forming one of the plurality of developed color images;

a plurality of sensors to detect surface potentials of the photosensitive member, in each position between the charging device and the developing device of each of image forming unit and in a position of downstream side of a last developing device which form the last one of developed color images on the photosensitive member;

an estimate device configured to estimate a predicted value of the surface potential of the photosensitive layer for one of developing devices using a first potential representing a surface potential before developing process of one of the developing devices and a second potential representing a surface potential after developing process of the other one of developing devices; and a control device configured to control the corresponding one of charging devices in the corresponding image forming unit in such a manner that the predicted value reaches to a predetermined developing reference value for the one of developing devices.

2. The apparatus of claim 1, wherein the control device controls the charging device in such a manner that a difference between the predicted values is not more than a predetermined value in unexposed and exposed portions by the image forming unit of the previous stage in the image forming units of the second and subsequent stages.

3. The apparatus of claim 1, wherein the control device controls the output of charging device in such a manner that a difference between the predicted values is not more than a predetermined value in unexposed and exposed portions by the image forming unit arranged at most upstream and in unexposed and exposed portions by the image forming unit arranged at the second and/or subsequent.

4. The apparatus of claim 1, wherein the each of surface potential sensors are arranged at equal intervals around the photosensitive member.

5. The apparatus of claim 4, wherein the control device controls the charging device in such a manner that a difference between the predicted values is not more than a predetermined value in unexposed and exposed portions by the image forming unit of the previous stage in the image forming units of the second and subsequent stages.

6. The apparatus of claim 4, wherein the control device controls the output of charging device in such a manner that a difference between the predicted values is not more than a predetermined value in unexposed and exposed portions by the image forming unit arranged at most upstream and in unexposed and exposed portions by the image forming unit arranged at the second and/or subsequent.

7. The apparatus of claim 1, further comprising:

an expose control device which estimates a predicted value after expose of the surface potential in the developing device of/an arbitrary color from a detection result before and after the developing, developed by the surface potential sensor in the image forming unit of the arbitrary color.

8. The apparatus of claim 7, wherein the expose control device controls the expose device in such a manner that the predicted value after the expose indicates an expose reference value.

9. The apparatus of claim 8, wherein the control device controls the charging device in such a manner that a difference between the predicted values is not more than a predetermined value in unexposed and exposed portions by the image forming unit of the previous stage in the image forming units of the second and subsequent stages.

10. The apparatus of claim 8, wherein the each of surface potential sensors are arranged at equal intervals around the photosensitive member.

11. A color image forming apparatus comprising:

photosensitive means, having a photosensitive layer for holding an electrostatic latent image;

first image forming means having a first charging means, a first expose means, and a first developing means,for forming a first color image on the photosensitive means;

second image forming means having a second charging means, a second expose means, and a second developing means,for forming a second color image to be superimposed with the first color image on the photosensitive means;

first detecting means for detecting a surface potential of a position of the photosensitive means between the first charging means of the first image forming means and the first developing means of the first image forming means to obtain a first detection result;

second detecting means for detecting a surface potential of a position of the photosensitive means between the second charging means of the second image forming means and the second developing means of the second image forming means to obtain a second detection result;

third detecting means for detecting a surface potential of a position of the photosensitive means of the downstream side of the second developing means of the second image forming means to obtain a third detection result;

first control means for determining a first predicted value of the surface potential of a position at the photosensitive means positioned opposite to the first developing means, and for controlling the first charging means in such a manner that the predicted value indicates a developing reference value; and second control means for determining a second predicted value of the surface potential of a position at the photosensitive means positioned opposite to the second developing device, and for controlling the second charging device in such a manner that the predicted value indicates a developing reference value.

12. The apparatus of claim 11, wherein the first to the third detecting means are arranged at equal intervals around the photosensitive means.

13. The apparatus of claim 12, wherein the first control means controls the output of the first charging means in such a manner that a difference between the predicted values is not more than a predetermined value in unexposed and exposed portions by the first charging means and in unexposed and exposed portions by the second charging means.

14. The apparatus of claim 12, wherein the second control means controls the output of the second charging means in such a manner that a difference between the predicted values is not more than a predetermined value in unexposed and exposed portions by the second charging means and in unexposed and exposed portions by the second charging means.

15. The apparatus of claim 12, further comprising:

an expose control means for controlling an intensity of expose with respect to a predicted value after expose of the first developing means and the second developing means, from the detection result before the developing detected by the first to the third detecting means, and the detection result after the developing, detected by the first to the third detecting means in such a manner that the predicted value after the expose indicates an expose reference value.

16. The apparatus of claim 15, wherein the first control means controls the output of the first charging means in such a manner that a difference between the predicted values is not more than a predetermined-value in unexposed and exposed portions by the first charging means and in unexposed and exposed portions by the second charging means.

17. The apparatus of claim 15, wherein the second control means controls the output of the second charging means in such a manner that a difference between the predicted values is not more than a predetermined value in unexposed and exposed portions by the second charging means and in unexposed and exposed portions by the second charging means.

18. A color image forming method comprising:

estimating a surface potential of an arbitrary color developing position positioning by an arbitrary color developing device from a detection result before the developing, detected by a surface potential sensor and a detection result after the developing, detected by the surface potential sensor controlling a charging device in such a manner that a predicted value of the surface potential before the expose indicates a defined developing reference value controlling an expose device in such a manner that the predicted value of the surface potential after the expose indicates a defined expose reference value; and controlling a charging amount by the charging device is controlled in consideration of charging histories by the charging devices of previous colors.

19. The method of claim 18, wherein two of the surface potentials per developing device are disposed before/after the developing device of each.

* * * * *